US011179598B2

(12) United States Patent
Shoshani

(10) Patent No.: US 11,179,598 B2
(45) Date of Patent: Nov. 23, 2021

(54) APPARATUS FOR BACK IMPROVEMENT AND LOWER-BACK AND KNEES PAIN RELIEVING

(71) Applicant: Abraham Shoshani, Jerusalem (IL)

(72) Inventor: Abraham Shoshani, Jerusalem (IL)

( * ) Notice: Subject to any disclaimer, the term of this patent is extended or adjusted under 35 U.S.C. 154(b) by 54 days.

(21) Appl. No.: 16/774,001

(22) Filed: Jan. 28, 2020

(65) Prior Publication Data

US 2021/0228941 A1 Jul. 29, 2021

(51) Int. Cl.

| | |
|---|---|
| ***A63B 23/04*** | (2006.01) |
| ***A63B 21/04*** | (2006.01) |
| ***A63B 23/02*** | (2006.01) |
| ***A63B 21/00*** | (2006.01) |
| ***A63B 21/008*** | (2006.01) |
| *A63B 23/00* | (2006.01) |

(52) U.S. Cl.

CPC ..... *A63B 23/0405* (2013.01); *A63B 21/008* (2013.01); *A63B 21/0421* (2013.01); *A63B 21/0428* (2013.01); *A63B 21/4034* (2015.10); *A63B 23/0233* (2013.01); *A63B 21/4015* (2015.10); *A63B 2023/006* (2013.01); *A63B 2208/0285* (2013.01); *A63B 2220/58* (2013.01); *A63B 2220/80* (2013.01)

(58) Field of Classification Search

CPC ..... A63B 21/0421; A63B 21/0428; A63B 21/4034; A63B 21/00047; A63B 21/008; A63B 21/0083; A63B 21/0085; A63B 21/0087; A63B 21/0088; A63B 21/4011; A63B 21/4013; A63B 21/4015; A63B 21/4027; A63B 21/4029; A63B 21/4031; A63B 21/4033; A63B 21/4037; A63B 23/0233; A63B 23/0405; A63B 23/02; A63B 23/0216; A63B 2220/80; A63B 2220/58; A63B 2208/0285; A63B 2023/006

See application file for complete search history.

(56) References Cited

U.S. PATENT DOCUMENTS 6,334,624 B1 * 1/2002 Giglio ..... A63B 21/0087 280/304.1
7,878,949 B2 * 2/2011 Chen ..... A63B 21/0552 482/52

(Continued)

FOREIGN PATENT DOCUMENTS

EP 3132785 B1 1/2020

*Primary Examiner* — Megan Anderson
(74) *Attorney, Agent, or Firm* — Alphapatent Associates, Ltd; Daniel J. Swirsky

(57) ABSTRACT

Apparatus for back improvement and lower-back pain and knees relieving, the apparatus including, for each foot of a user, a pedal shiftable along a linear axis, for allowing a foot of the user to exert force on the pedal, a sensor, for continuously sensing a force exerted on the pedal by the foot, a linear actuator having a longitudinal bore in a piston thereof, the linear actuator being configured to move the piston away from the pedal when the force on the pedal exceeds a first threshold, and a controller for reading a sensing of the sensor, the controller being adapted to instruct the mechanism to move the piston away from the pedal such that the pedal retracts in response to pressure exerted by the foot.

14 Claims, 6 Drawing Sheets

(56) References Cited

U.S. PATENT DOCUMENTS

| | | | | |
|---|---|---|---|---|
| 2002/0193210 | A1* | 12/2002 | Turner | A63B 21/4015 482/80 |
| 2008/0113853 | A1 | 5/2008 | Jang | |
| 2013/0184617 | A1* | 7/2013 | Inaba | A63B 21/0004 601/33 |
| 2015/0141200 | A1 | 5/2015 | Murray et al. | |
| 2018/0056122 | A1* | 3/2018 | Lind | A63B 21/0087 |
| 2020/0282254 | A1* | 9/2020 | Hong | A63B 24/0087 |
| 2020/0298042 | A1* | 9/2020 | Hsieh | A63B 22/0056 |

* cited by examiner (f)

(g)

(h)

(i)

(j)

APPARATUS FOR BACK IMPROVEMENT AND LOWER-BACK AND KNEES PAIN RELIEVING

FIELD

The invention relates to the field of healthcare exercising devices.

BACKGROUND

In a human body's upright state, the lower vertebrae of the spine carries the weight of the upper body. If the body is "normal", i.e., the spine doesn't have degenerative or other changes, the weight of the body rests on all of the vertebrae, and as such no pain is felt. However, in the case of a body that suffers from degenerative or other changes (e.g., the vertebrae have moved from their normal position), the burden of the upper part of the body falls only on some of the vertebrae, and as such it results with pain, which interferes the day life of the person.

US2008/0113853 discloses "a backbone correction exercise apparatus in which a user lies on a bed and wears a pelvis belt, adjusts distance from an exercise unit depending on a user's physical condition, and then perform recursive exercises, to thereby slack and restore the cervical vertebra portion and the lumbar vertebra portion of the human body repeatedly and to thus strengthen spinal peripheral support muscles in order to provide a spinal curative effect as well as a spinal exercise effect. The backbone correction exercise unit includes an exercise unit which enables a user to lie on a bed and take an exercise using the user's feet, and a pelvis belt which is fixed to the bed on which the user lies and a portion corresponding to the waist of the user who lies on the bed, and which holds the user's waist to then be fixed to the bed."

Generally speaking, it is a spin bike, adapted such that exercising is carried out while a user thereof lies horizontally on his back. It uses a pelvic belt which holds the user's waist, in order to prevent the user from sliding while practicing.

US2015/0141200 discloses a recumbent exercise machines and associated systems and methods. In one embodiment, for example, a recumbent exercise apparatus can include a seat, two linear guide tracks forward of the seat, and two pedal assemblies movably coupled to corresponding linear guide tracks positioned forward of the seat. In one embodiment of the invention, a submitting is carried out by retracting the pedal upon detecting that the force exerted by the user is greater than a predetermined threshold.

All the methods described above have not yet provided satisfactory apparatus for improving back situation and decreasing pain of the lower back spine.

SUMMARY

In one aspect, the invention is directed to an apparatus (100) for back improvement and lower-back and knees pain relieving, the apparatus comprising for each foot of a user:

- a linear actuator (20) having a longitudinal bore (14) in a piston (34) thereof;
- a shaft (36) shiftable in the bore (14);
- a pedal (40) connected to the shaft (36);
- a spring (38), disposed between the piston (34) and the pedal (40), for objecting to shift the pedal towards the piston;

- a sensor (18), for measuring a force exerted on the pedal (40) by a foot of the user;
- a controller (10) in communication with the sensor (18) for obtaining from the sensor the force, the controller adapted to instruct the linear actuator to move the piston (34) away from the pedal (40) when the force exceeds a first threshold, and retract the piston back when the force drops under a second threshold; and
- a first joint (26), for connecting the linear actuator (20) to a vertical support (24), and fixing the linear actuator thereto.

According to one embodiment of the invention, the pedal (40) is connected to the shaft (36) via a second joint (46).

Each of the joints may be a ball joint, pivotal joint, universal joint, and the like.

Preferably the sensor (18) is a piezoelectric sensor; however, according to one embodiment of the invention the sensor measures the distance the pedal shifts as a substitute to measuring the exerted force on the pedal. For example, upon detecting that the pedal has shifted more than 7 cm (the threshold), the linear actuator retracts a predetermined distance.

Preferably, the pedal further comprises a heel rest (42), and side support (44).

Preferably, the apparatus comprises a horizontal support (22) on which a user lies, a vertical support (24) for said linear actuators (20), and a handles (16) attached to said horizontal support (22) to be held by said user in order to prevent his sliding on the horizontal support.

In another aspect, the invention is directed to an apparatus (100) for back improvement and lower-back and knees pain relieving, the apparatus comprising for each foot of a user:

- a pedal (40) shiftable along a linear axis, for allowing a foot of the user to exert force on the pedal (40);
- a sensor (18), for continuously sensing a force exerted on the pedal (40) by the foot;
- a mechanism for exerting resistance force on the pedal; and
- a controller (10) reading a sensing of the sensor, the controller being adapted to instruct the mechanism to exert continuous resistance force on the pedal such that the pedal submits to the foot.

The submitting is carried out by retracting the pedal upon detecting that the force exerted by the user is greater than a predetermined threshold.

According to one embodiment of the invention, the apparatus further comprises a spring disposed between the pedal and the apparatus, for smoothing an operation thereof.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

BRIEF DESCRIPTION OF DRAWINGS

Embodiments, features, and aspects of the invention are described herein in conjunction with the following drawings.

It should be understood that the drawings are not necessarily drawn to scale.

DETAILED DESCRIPTION

The invention will be understood from the following detailed description of embodiments of the invention, which are meant to be descriptive and not limiting. For the sake of brevity, some well-known features, methods, systems, procedures, components, circuits, and so on, are not described in detail.

A linear actuator is an actuator that creates motion in a straight line, in contrast to, for example, a circular motion of a conventional electric motor. Linear actuators comprise a cylinder, in which a piston is movable. Linear actuators may be based on pneumatics, hydraulics, and electrics.

Generally speaking, the invention is directed to an exercising apparatus for back improvement and for lower-back and knees pain relieving. The apparatus comprises a pair of linear actuators, correspondingly to a user's feet. Each linear actuator comprises a pedal and footrest at the end thereof, on which the users' feet rest. Each linear actuator also comprises a sensor, for measuring the force exerted by a user's foot on the corresponding linear actuator.

The linear actuators exert continuous force on the user's feet; however they "submit" to the force exerted by the user. In other words, when the user increases the force exerted on the pedal, the linear actuators retract.

As a result of the exercise, the lower backbone muscles and pelvic muscles of a user strengthen, and the greater the power of the user's muscles participating in carrying the weight of the upper side of the user's body, the less force is applied on the user's vertebrae.

Figure 1:
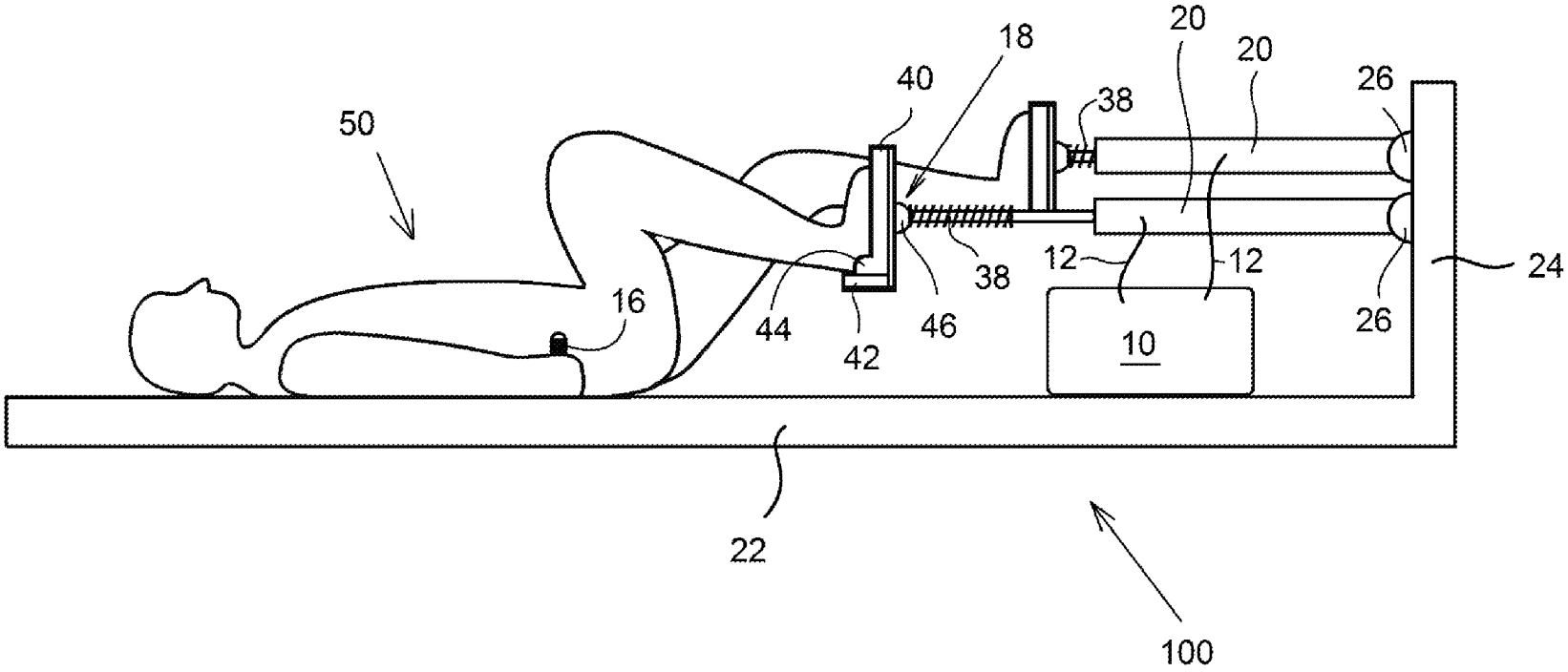
FIG. 1 schematically illustrates an apparatus 100 for back improvement and lower-back and knees pain relieving, according to one embodiment of the invention.

FIG. 1 schematically illustrates an apparatus 100 for back improvement and lower-back and knees pain relieving, according to one embodiment of the invention.

The apparatus comprises a pair of linear actuator 20, which is controlled by a controller 10, as detailed hereinafter. The communication of the linear actuators with the controller 10 is carried out by communication lines 12. The communication lines 12 may be wired or wireless.

The controller allows each foot to train separately from the other. Thus, the exercising of each foot is carried our separately from the other, although the mechanisms may share the same controller.

The term joint refers herein to a mechanical device for coupling two parts such that the orientation of one part with reference to the other part is changeable. A pivotal joint is a joint in which one part can change its situation with reference to the other around an axis. A ball joint uses a ball to allow changing the orientation of one part with reference to the other in any direction.

Each of the linear actuators 20 is connected to a vertical support 24 by a first joint 26, which allows situating the linear actuator in a desired orientation and fixing thereof in this situation. Additionally, each of the linear actuators 20 may be situated in a different location on the vertical support 24. The vertical support may also be a domestic wall.

The location and orientation of each of the linear actuators must be adjusted and fixed before the training. Thus during training each of the feet moves forth and back along the longitudinal axis of its corresponding linear actuator.

To the other end of each of the linear actuators 20 is connected a pedal 40 by a ball or pivotal joint second 46. In contrast to the first joints 26, it is preferable to leave each of the joints 46 free to move during training, thereby allowing each of the pedals 40 to adjust its situation according to the foot orientation.

Preferably the pedal 40 comprises a heel rest 42 on which the user's heel stands, and side support 44.

Joints 46 and 26 may be ball joints, pivotal joints, universal joints (a generic term), and the like.

Figure 2:
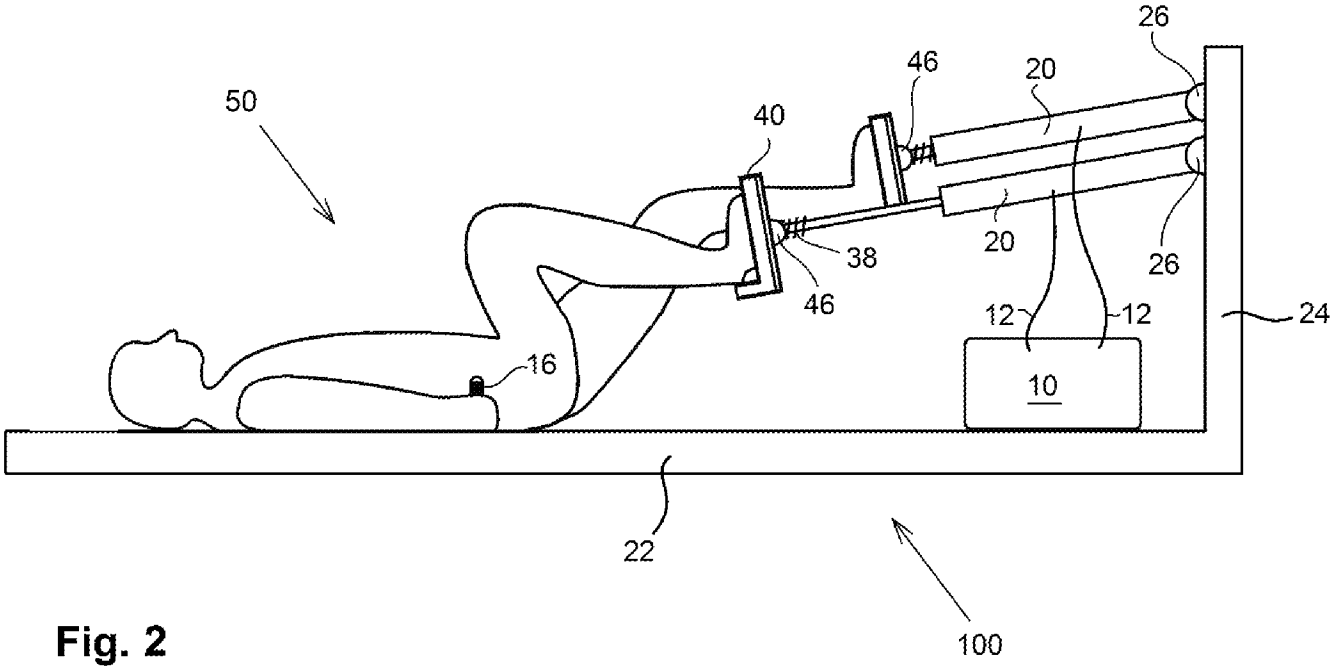
FIG. 2 schematically illustrates the apparatus 100 of FIG. 1, in another situation.

FIG. 2 schematically illustrates the apparatus 100 of FIG. 1, in another situation.

In this situation the ball joints 26 have been placed higher in comparison to their situation in FIG. 1, and their orientation is sloped.

Figure 3:
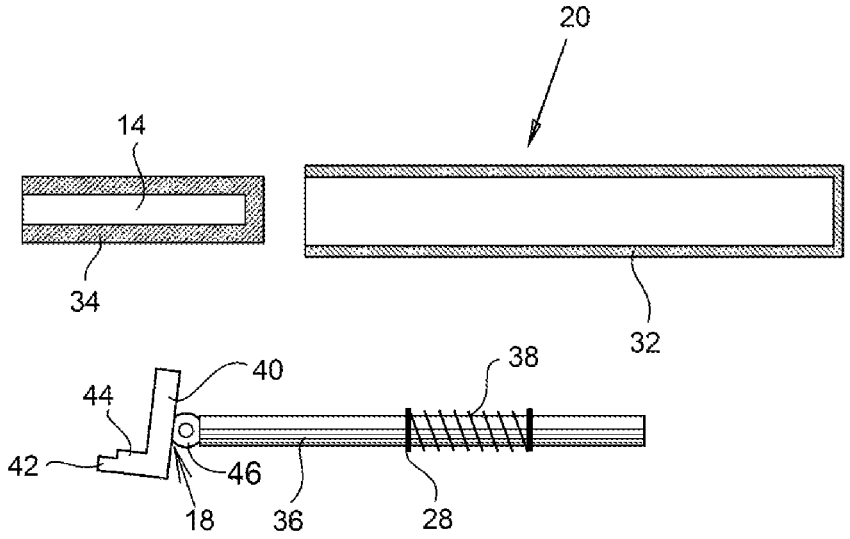
FIG. 3 schematically illustrates the parts of a linear actuator, according to one embodiment of the invention.

FIG. 3 schematically illustrates the parts of a linear actuator, according to one embodiment of the invention.

The linear actuator 20 according to the invention comprises an external tube 32 (illustrated cross-sectioned) and a piston 34 (illustrated cross-sectioned). Thus, the piston 34 is moveable with reference to the external tube 32 according to commands of the controller 10 (shown in FIGS. 1 and 2).

The piston has a longitudinal bore 14 in which is disposed a shaft 36. Pedal 40 is coupled to shaft 36 by a joint 46.

On shaft 36 is installed a ledge 28. A spring 38 is disposed between ledge 28 and the edges of piston 34.

Figure 4:
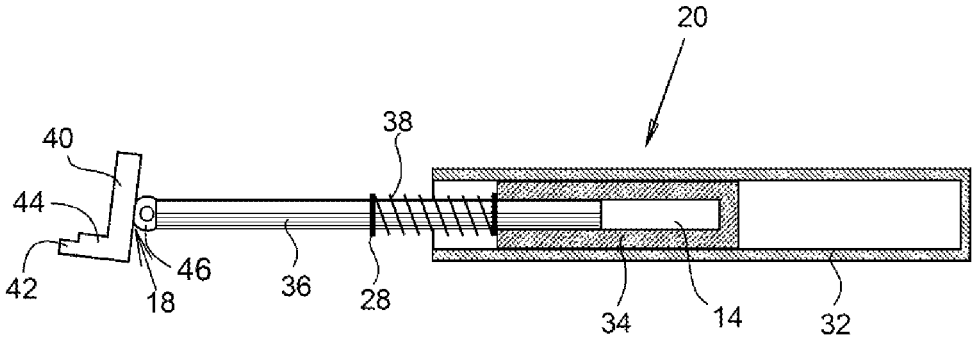
FIG. 4 schematically illustrates the composed linear actuator, according to one embodiment of the invention.

FIG. 4 schematically illustrates the composed linear actuator 20, according to one embodiment of the invention.

Piston 34 is movable in the external tube 32 according to commands from the apparatus controller. Actually, this is the only part that moves according to the commands of a controller.

Figure 5A:
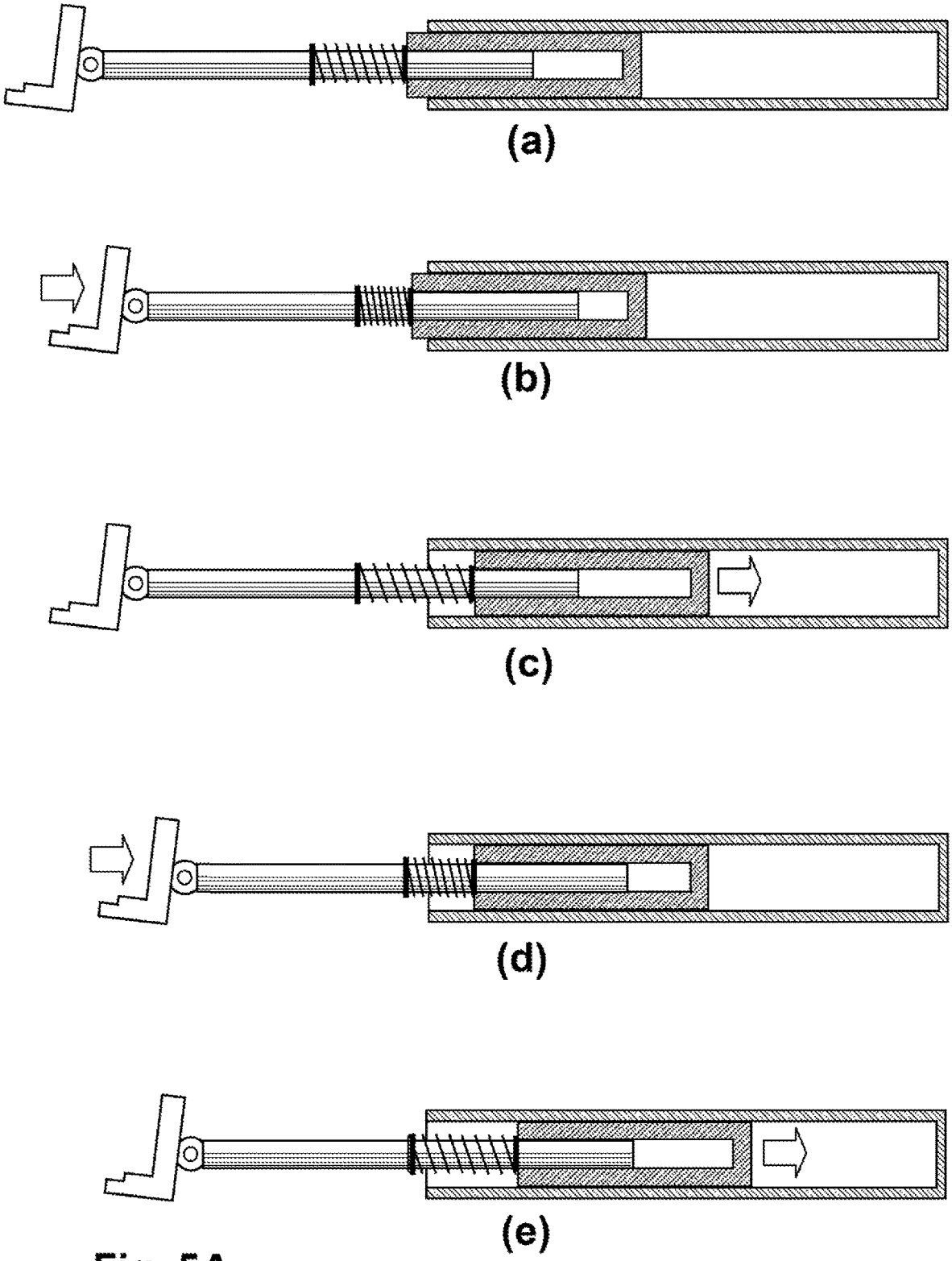
FIGS. 5A, 5B and 6 schematically demonstrate the way the linear actuator operates, according to one embodiment of the invention.
Figure 5B:
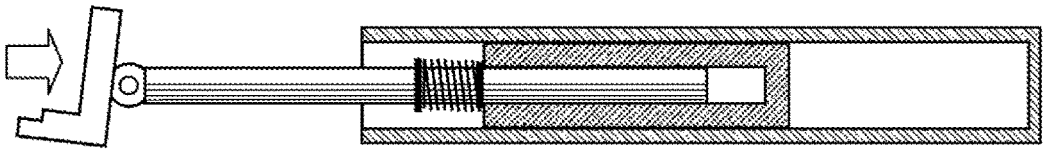
Figure 5B:
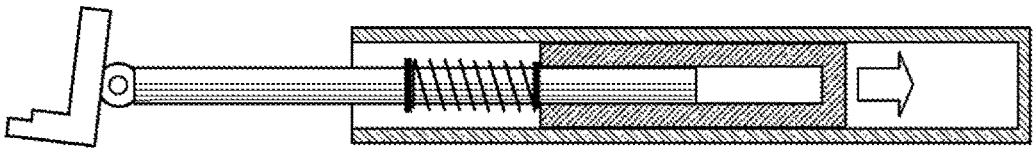
Figure 5B:
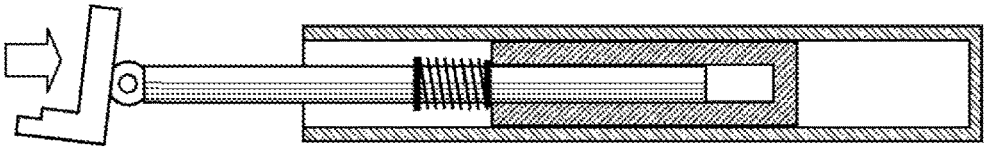
Figure 5B:
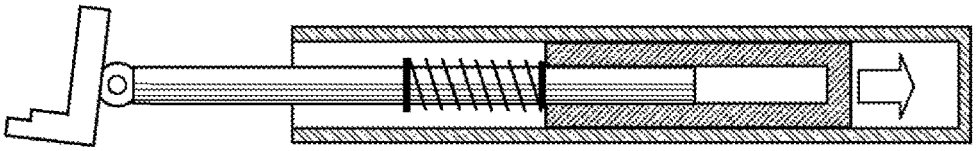
Figure 5B:
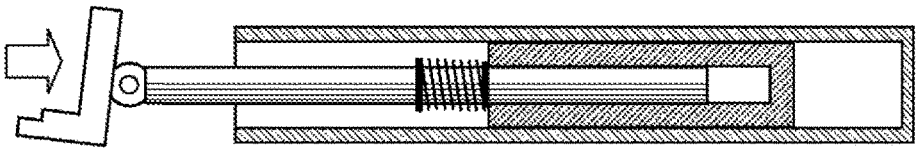
Figure 6:
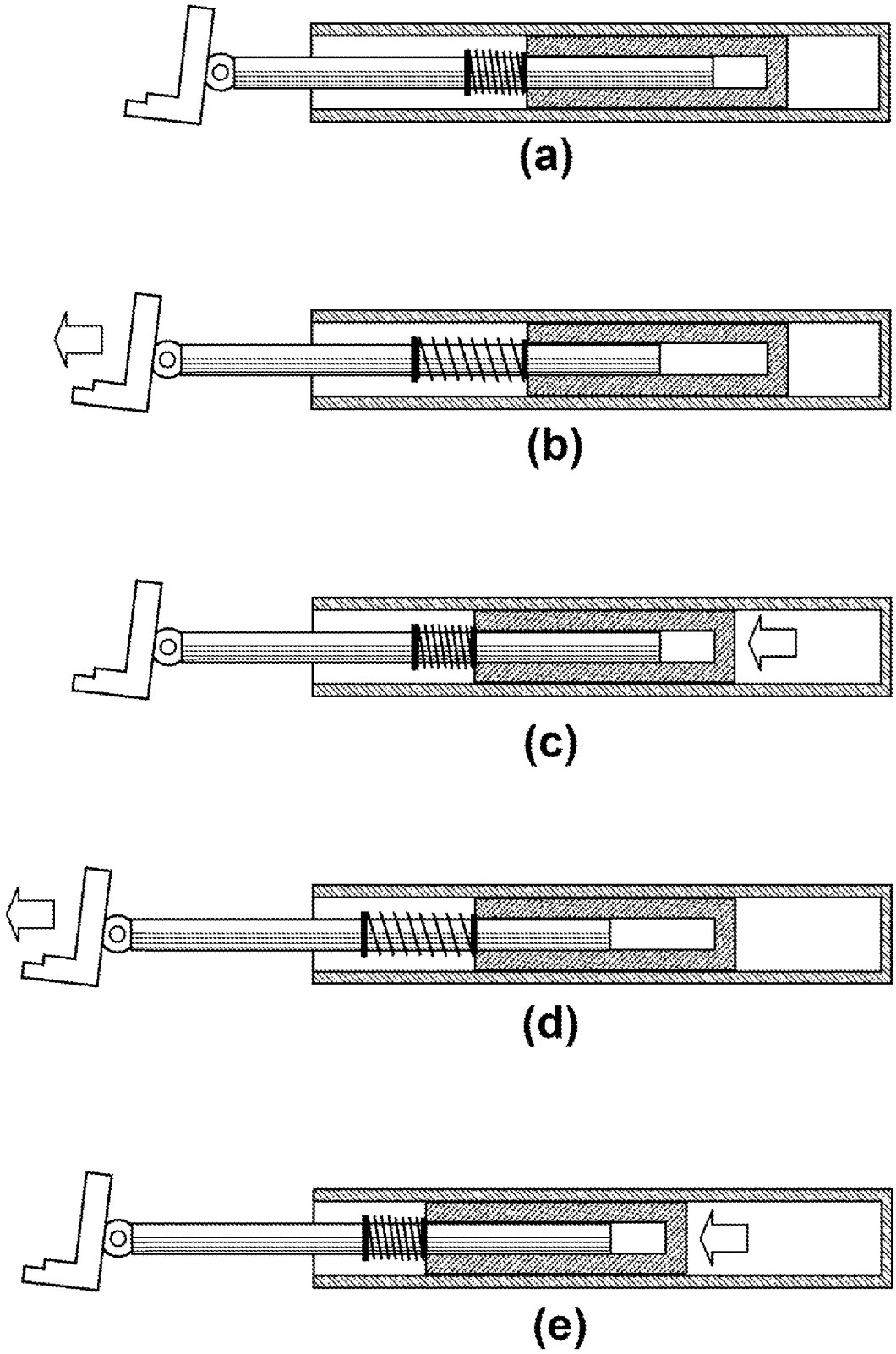

FIGS. 5A, 5B and 6 schematically demonstrate the way the linear actuator 20 operates, according to one embodiment of the invention.

FIGS. 5A and 5B demonstrate the operation of pushing the pedal away from the user, and FIG. 6 demonstrates the retraction of the user foot.

FIGS. 5A and 5B demonstrate the operation of pushing the pedal away from the user. It comprises stages from (a) to (j). Stage (a) of FIG. 5A is the idle stage.

In step (b) of FIG. 5A the user pushes the pedal in the direction illustrated by the arrow. As a result, the spring shrinks and the shaft enters into the piston.

The force exerted by the user on the pedal is sensed by the sensor 18 (marked in FIG. 1), and monitored by the controller. Such a sensor may be, for example, a piezoelectric sensor.

As the force sensed by the sensor exceeds a defined threshold, the piston moves away from the user, as illustrated in stage (c) of FIG. 5A. The arrow demonstrates the direction in which the piston moves.

At this stage the user may take a rest, and once he has recovered, he exerts power to overcome the objection of the spring, as illustrated in stage (d) of FIG. 5A.

The force exerted by the user on the pedal is monitored by the controller, and once it has reached the threshold, the piston moves away from the user, as illustrated in stage (e) of FIG. 5A.

The next steps (f) to (j) of FIG. 5B are the same, until the user stops to push the pedal.

As can be seen from the illustration, the pedal advances (moves to the right in the figure's orientation).

It should be noted that the force a user must exert depends on the threshold. Thus, the user may set the threshold to suit his present physical situation. If the person is "weak", the threshold may be relatively low. If the user is "strong", the threshold may be relatively high. Thus, the apparatus may use the same spring 38 for users of different physical strength.

It should be noted that the apparatus is oriented for people recovering from an injury in the legs, handicapped, and the like, although it may also be suitable for people in good shape.

It should be noted that the location of the shaft may also be used as an indicator of the force exerted on the pedal. For example, if the shaft moves 4 cm from its location at the time the piston has been shifted, it may be an indication to the controller to shift the piston. The threshold may be set by input means of the apparatus (not illustrated).

FIG. 6 demonstrates the operation of retracting the user's foot. It comprises stages (a) to (e). Stage (a) is the idle stage.

In step (b) the user retracts his foot, which causes the spring to elongate as illustrated in the figure.

As the controller detects that the exerted force has dropped under a predefined threshold, it retracts the piston toward the user, as illustrated in step (c). In this situation the spring is shrunk.

As the user continues to retract his foot as illustrated in step (d), the controller orders the piston to retract toward the user, as illustrated in step (e).

It should be noted that the threshold used for detecting when to move the piston away from the user may differ from the threshold used for detecting when to retract the piston towards the user.

Preferably, the linear actuator is electrical; however, it can also be pneumatic, hydraulic, and the like.

In another aspect, the invention is directed to an apparatus (100) for back improvement and lower-back and knees pain relieving, the apparatus comprising for each foot of a user:

- a pedal (40) shiftable along a linear axis, for allowing a foot of the user to exert force on the pedal (40);
- a sensor (18), for continuously sensing a force exerted on the pedal (40) by the foot;
- a mechanism for exerting resistance force on the pedal; and
- a controller (10) reading a sensing of the sensor, the controller being adapted to instruct the mechanism to exert continuous resistance force on the pedal such that the pedal submits to the foot.

According to one embodiment of the invention, the apparatus further comprises a spring disposed between the pedal and the apparatus, for smoothing an operation thereof.

The invention imitates the activity of a physician that treats patients suffering from back and particularly lower back pains. It has been developed according to conclusions of the Applicant after treating such patients over a period of many years.

In the figures and/or description herein, the following reference numerals (Reference Signs List) have been mentioned:

- numeral 100 denotes an apparatus for back improvement and for lower-back and knees pain relieving, according to one embodiment of the invention;
- numeral 10 denotes a controller;
- numeral 12 denotes communication lines, wired or wireless;
- numeral 14 denotes a longitudinal bore in a piston;
- numeral 16 denotes a holding handle;
- numeral 18 denotes a force sensor, such as piezoelectric sensor;
- numeral 20 denotes a linear actuator;
- numeral 22 denotes a horizontal support (may also be the floor);
- numeral 24 denotes a vertical support (may also be a wall) to the pistons;
- numeral 26 denotes a first joint (such as a ball or pivotal joint);
- numeral 28 denotes a ledge;
- numeral 32 denotes an external tube of linear actuator 20;
- numeral 34 denotes a piston of linear actuator 20;
- numeral 36 denotes a shaft of linear actuator 20;
- numeral 38 denotes a spring;
- numeral 40 denotes a pedal;
- numeral 42 denotes a heel rest of pedal 40;
- numeral 44 denotes a side support of pedal 40;
- numeral 46 denotes a second joint (such as a ball or pivotal joint); and
- numeral 50 denotes a patient.

In the description herein, the following references have been mentioned: US2008/0113853 to Suk Hwan Jang and US2015/0141200 to Murray, et al.

The foregoing description and illustrations of the embodiments of the invention has been presented for the purposes of illustration. It is not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. An apparatus for back improvement and lower-back and knees pain relieving, the apparatus comprising for each foot of a user:

- a linear actuator having a longitudinal bore in a piston thereof and a shaft, wherein said shaft is shiftable in said longitudinal bore;
- a pedal connected to said shaft;
- a spring, disposed between said piston and said pedal, for resisting movement of said pedal towards said piston;
- a sensor, for measuring a force exerted on said pedal by the foot of said user or a distance said pedal shifts; and
- a first joint, for connecting said linear actuator to a vertical support, and fixing said linear actuator thereto, said apparatus further comprising a controller in communication with each said sensor for obtaining from said respective sensor said respective force, said controller adapted to instruct each said linear actuator to move said respective piston away from said respective pedal when said respective force exceeds a first threshold, and retract said respective piston back when said respective force drops under a second threshold.

2. The apparatus according to claim 1, wherein said pedal is connected to said shaft via a second joint.

3. The apparatus according to claim 2, wherein said second joint is selected from a group consisting of: ball joint, pivotal joint, universal joint.

4. The apparatus according to claim 1, wherein said first joint is selected from a group consisting of: ball joint, pivotal joint, universal joint.

5. The apparatus according to claim 1, wherein said sensor is a piezoelectric sensor.

6. The apparatus according to claim 1, wherein said sensor measures a distance said pedal shifts.

7. The apparatus according to claim 1, wherein said pedal further comprises a heel rest.

8. The apparatus according to claim 1, wherein said pedal further comprises a side support.

9. The apparatus according to claim 1, further comprising a horizontal support on which the user lies, and handles attached to said horizontal support configured to be held by said user.

10. An apparatus for back improvement and lower-back and knees pain relieving, the apparatus comprising for each foot of a user:

a pedal shiftable along a linear axis, for allowing the foot of said user to exert force on said pedal;

a sensor, for continuously sensing a force exerted on said pedal by said foot or for measuring a distance said pedal shifts;

a linear actuator having a longitudinal bore in a piston thereof, the linear actuator being configured to move the piston away from the pedal when the force on the pedal exceeds a first threshold thereby exerting a continuous resistance force on said pedal; and the apparatus further comprising a controller reading a sensing of each said sensor, said controller being adapted to instruct each said linear actuator to exert continuous resistance force on said respective pedal such that said respective pedal retracts in response to said respective continuous pressure exerted by said respective foot.

11. The apparatus according to claim 10, the retracting is carried out by retracting said pedal upon detecting that the force exerted by said user is greater than a predetermined threshold.

12. The apparatus according to claim 10, further comprising a spring disposed between each said pedal and said respective piston, for smoothing an operation thereof.

13. The apparatus according to claim 10, wherein said sensor is a piezoelectric sensor.

14. The apparatus according to claim 10, wherein said sensor measures a distance said pedal shifts.

* * * * *